United States Patent [19]

Raasch

[11] Patent Number: 4,944,463

[45] Date of Patent: Jul. 31, 1990

[54] APPARATUS FOR CROSS-WINDING A TRAVELING YARN

[75] Inventor: Hans Raasch, Moenchengladbach, Fed. Rep. of Germany

[73] Assignee: W. Schlafhorst & Co., Fed. Rep. of Germany

[21] Appl. No.: 346,874

[22] Filed: May 3, 1989

[30] Foreign Application Priority Data

May 5, 1988 [DE] Fed. Rep. of Germany .... 3815253

[51] Int. Cl.[5] ..... B65H 54/46

[52] U.S. Cl. ..... 242/18 DD; 242/43 R

[58] Field of Search ..... 242/18 DD, 43 R

[56] References Cited

U.S. PATENT DOCUMENTS

| | | | |
|---|---|---|---|
| 2,664,249 | 12/1953 | Wright | 242/43 R |
| 3,092,339 | 6/1963 | Hill, Jr. et al. | 242/18 DD |
| 3,690,578 | 9/1972 | Morgan et al. | 242/18 DD |
| 3,792,819 | 2/1974 | Schippers | 242/43 R |
| 3,830,439 | 8/1974 | Porter | 242/18 DD |
| 3,861,607 | 1/1975 | Schippers et al. | 242/18 DD |

FOREIGN PATENT DOCUMENTS

| | | | |
|---|---|---|---|
| 2243507 | 3/1974 | Fed. Rep. of Germany . | |
| 2419422 | 12/1974 | Fed. Rep. of Germany | 242/18 DD |
| 2449242 | 4/1976 | Fed. Rep. of Germany | 242/18 DD |
| 39132 | 11/1971 | Japan | 242/18 DD |

*Primary Examiner*—Stanley N. Gilreath

*Attorney, Agent, or Firm*—Shefte, Pinckney & Sawyer

[57] ABSTRACT

In a yarn cross-winding apparatus of the type wherein a driven winding drum peripherally drives a bobbin and a traversing yarn guide applies yarn in a cross-wound fashion to the bobbin periphery, the problem of increased yarn winding density at the opposite ends of the bobbin is avoided by forming opposite peripheral end areas of the winding drum, whereat cross-winding yarn reversal occurs, with oppositely angled intersecting grooves forming a plurality of relatively staggered yarn engagement locations over the circumferential and axial extent of the peripheral end areas of the drum. The yarn engagement locations guide the yarn onto the bobbin at its opposite ends to resist deviation of the yarn from its cross-winding angle at the location of yarn cross-winding reversal.

5 Claims, 1 Drawing Sheet

APPARATUS FOR CROSS-WINDING A TRAVELING YARN

BACKGROUND OF THE INVENTION

The present invention relates to apparatus for cross-winding a traveling yarn on a bobbin, and more particularly, to yarn winding apparatus of this type wherein the bobbin is peripherally driven by a winding drum and a yarn guide traverses the traveling yarn along the bobbin to apply the yarn thereon in a cross-wound fashion.

In yarn cross-winding apparatus of the aforementioned type, a common disadvantage is the tendency of yarn to be wound more densely at the ends of the bobbin, which is particularly problematic in the production of dye bobbins wherein the yarn winding density should be as low as possible to facilitate the yarn dyeing process. To achieve this objective, yarn should be wound with an appropriately sharp crossing angle. However, the use of a relatively sharp crossing angle for this purpose tends to cause the yarn to draw axially inwardly with respect to the lengthwise extent of the bobbin at its opposite ends whereat the reversal of yarn cross-winding occurs. As a result, the yarn windings compact at the axial ends of the bobbin so that the effective axial extent of the yarn windings on the bobbin is shorter than that prescribed by the traversing yarn guide and, in turn, only the central extent of the yarn windings on the bobbin have the desired low density with the axial ends of the bobbin being more densely formed than desirable. Further, this problem cannot be compensated by enlarging the yarn traversal, which only serves to form the densified windings of yarn at a greater spacing from one another. The yarn windings at the opposite ends of the bobbin still tends to move axially inwardly with a relatively flattened reversal angle so that the yarn is still more densely wound at the bobbin ends.

West German Offenlegungsschrift 22 42 507 discloses a yarn winding apparatus of the aforementioned type wherein the winding drum which frictionally drives the bobbin is formed with a central peripheral area which is substantially smooth and with peripheral areas at the opposite ends formed with concentric or helical grooves to assist in applying the yarn to the ends of the bobbin during winding. However, the use of such an arrangement of grooves on the winding drum requires that the winding drum and the traversing yarn guide must be synchronized with one another so that a groove of the winding drum is properly located at the point of yarn contact with the bobbin when the traversing yarn guide reaches each opposite end of its traversing movement. As a result, certain set translation ratios must be maintained between the winding drum and the traversing yarn guide and, in turn, the possible range of selective adjustment of the desired yarn cross-winding angle is reduced.

SUMMARY OF THE INVENTION

It is accordingly an object of the present invention to provide an improved winding drum for a yarn cross-winding apparatus of the aforementioned type which provides the advantage of applying yarn to a bobbin without significant deviation from the desired yarn cross-winding angle at the bobbin ends while also enabling a reasonably large range of selective adjustment of a desired cross-winding angle.

Briefly summarized, the winding drum of the present invention has a generally smooth peripheral area centrally along the winding drum with two peripheral areas spaced from one another at opposite ends of the central peripheral area for contact respectively with opposite end areas of the bobbin whereat reversal of the cross-winding of the yarn occurs. Each of the spaced peripheral areas defines a plurality of yarn engagement locations spaced with respect to one another over the circumferential and axial extents of the spaced peripheral area for guiding the yarn onto the bobbin at its opposite end areas to resist deviation of the yarn from its cross-winding angle at the location of yarn cross-winding reversal. In this manner, at any translation ratio between the winding drum and the yarn guide and any cross-winding of the yarn, the yarn will automatically enter an appropriate yarn engagement location at the respective ends of the winding drum upon each reversal of the traversing movement of the yarn guide at each opposite end of the bobbin without any need for any relatively precise correlation between the translation ratio and the arrangement of the yarn engagement locations.

Preferably, each of the spaced peripheral areas of the winding drum has respective peripheral grooves oppositely formed obliquely to the axis of the winding drum for intersecting one another so that each intersection of the grooves forms a respective yarn engagement location. In the preferred embodiment, two sets of such grooves form each peripheral area, one set of grooves extending parallel to one another at a common oblique angle to the drum axis and the other set of grooves extending parallel to one another at a common oblique angle substantially oppositely to that of the first set of grooves for crossing relation therewith. The yarn engagement locations at the groove intersections may be optimized for any desired yarn count by suitable adjustment of the width and depth of the groove as well as the angularity of the lateral walls defining each groove. Moreover, the winding geometry of the bobbin may be influenced by the positioning of the yarn engagement loctions. This result is particularly possible in that it is not necessary that the two sets of parallel grooves by formed at the same oblique angle relative to the axis of the winding drum. However, as will be understood, if the angle of inclination of the first set of parallel grooves is inversely equal to the angle of inclination of the second set of parallel grooves to the bobbin axis, the yarn engagement locations are formed precisely in a geometric diamond pattern about the periphery of the winding drum. As a result, the yarn engagement locations are arranged in a series of axially extending rows which are parallel to one another and to the axis of the winding drum. At the same time, the yarn engagement locations of each row are staggered axially with respect to each adjacent row.

Because of this arrangement of the yarn engagement locations, as the traversing yarn guide passes each grooved peripheral area at the completion of each traversing stroke of the guide, the yarn immediately engages automatically in a yarn engagement location depending upon the position of the yarn guide, even though the appropriate yarn engagement location may not be located exactly adjacent the yarn as it exits the yarn guide. Accordingly, it is not necessary to synchronously coordinate the yarn guide are the yarn engagement locations on the winding drum to insure that a yarn engagement location is always located at the precise point of yarn application to the bobbin when the yarn guide reverses its traversing movement.

In the preferred embodiment, the spaced peripheral areas of the winding drum are provided with a coating of a frictional material in which the intersecting grooves are formed to produce the yarn engagement locations. Typically, the frictional coating is a thermoplastically deformable material rather than a metal so that a more economical formation of the grooves in the frictional coating is possible. For example, the application of the frictional coating and the formation of the grooves and yarn engagement locations may advantageously be performed in one step.

DESCRIPTION OF THE PREFERRED EMBODIMENT

Figure 1:
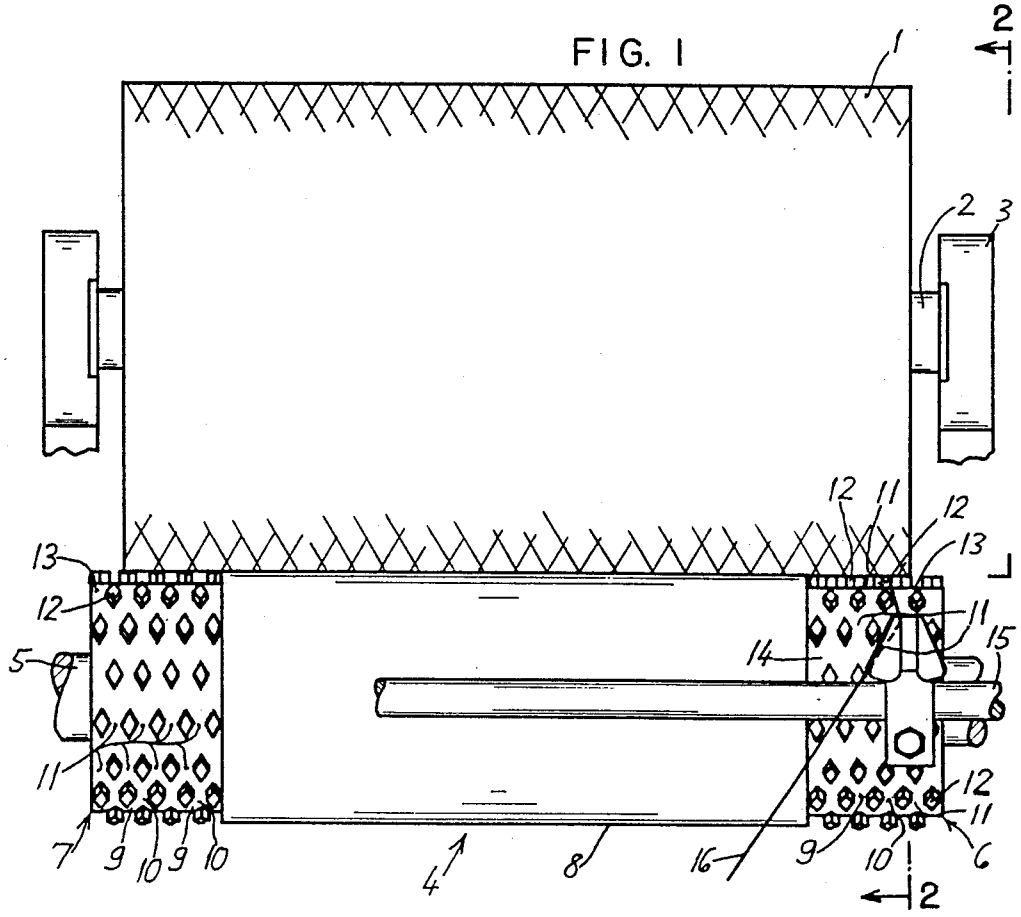
FIG. 1 is a front elevational view of a yarn cross-winding apparatus according to the preferred embodiment of the present invention.

Referring now to the accompanying drawings, a yarn cross-winding apparatus according to the preferred embodiment of the present invention is shown in pertinent part, conventional features and components of the apparatus being omitted for sake of simplicity. Basically, the apparatus includes a winding drum 4 mounted on a shaft 5 which is driven in conventional fashion by a drive motor or other suitable means (not shown). A bobbin tube 2 is rotatably supported in a bobbin holder 3 of conventional construction. A yarn 16 to be wound about the bobbin tube 2 is trained through a yarn guide 14 mounted on a yarn guide rod 15 which is driven by a drive motor or other suitable drive (not shown) to actuate a traversing movement of the yarn guide 14 back-and-forth along the length of the bobbin tube 2. At the start of a winding operation, the bobbin tube 2 is held by the bobbin holder 3 in peripheral surface contact with the winding drum 4 to be driven thereby simultaneously with the traversing of the yarn guide 14 to initiate the cross-winding of the yarn 16 on the tube 2. As the cross-windings of the yarn 16 build progressively on the bobbin tube 2, as indicated at 1, the bobbin holder 3 maintains the yarn windings 1 in surface driven contact with the winding drum 4.

As best seen in FIG. 1, a series of intersecting grooves 9, 10 are formed in the periphery of the winding drum 4 in the areas of the opposite ends 6, 7 thereof which respectively contact the opposite ends of the would bobbin 1 whereat the reversal of the cross-winding of the yarn 16 under the traversing movement of the yarn guide 14 occurs. The predominant lengthwise area 8 of the winding drum 4 intermediate the end areas 6, 7 has a smooth periphery substantially identical in cicumference and diameter to the outermost circumference and diameter of the non-grooved portions of the end areas 6, 7. Preferably, the end areas 6, 7 of the winding drum 4 have a peripheral coating 13 of a frictional material which may be, for example, a plastic, rubber or a rubber-like material. The frictional coating 13 permits the grooves 9, 10 to be produced during the step of forming the coating 13 on the ends 6, 7 of the winding drum 4. By way of example, the coating 13 may be press-fitted or shrink-fitted onto the ends 6, 7 of the winding drum 4.

As shown in FIG. 1, the grooves 9 are formed at each end of the winding drum 4 as a series of spaced parallel grooves each extending at an obtuse angle inclined rightwardly with respect to the axis, i.e. the shaft 5, of the winding drum 4, while the grooves 10 are likewise formed at each end of the winding drum 4 as a series of spaced parallel grooves extending at an obtuse angle leftwardly with respect to the axial shaft 5 of the winding drum 4. As a result, the two sets of parallel grooves 9, 10 intersect at each end of the winding drum 4 to form a yarn engagement location 11 at each intersection. The spacing of the respective grooves 9, 10 leave a plurality of knob-like projections 12 extending outwardly intermediate the yarn engagement locations 11. As shown, the respective obtuse angles at which the set of paralle grooves 9 and the set of parallel grooves 10 are formed are identical but inverse or opposite to one another relative to the axis of the winding drum 4. Additionally, the relative spacing of the grooves 9 and the relative spacing of the grooves 10, as shown is substantially identical. Accordingly, the yarn engagement locations 11 are arranged at each end 6, 7 of the winding drum 4 in linear rows which extend axially relative to the winding drum 4 in parallel relation to one another and at circumferential spacings about the periphery of the drum, leaving the knob-like projections 12 in a diamond pattern with each projection 12 having a substantially diamond-shaped cross section. Of course, as will be recognized, the respective angles at which the grooves 9 and the grooves 10 are formed may be different from one another and the spacing of the grooves, as well as their width and depth, may be varied as desired, whereby the orientation and arrangement of the yarn engagement locations 11 and the size and shape of the knob-like projections 12 would be correspondingly varied. Further, the configuation of the knob-like projections 12 may be varied by subsequent processing operations to form the projections 12 with any desired shape, for example, a round or elliptical cross-section as well as a cylindrical or conical contour.

The width and depth of the grooves 9, 10 should be selected in relation to the count of the yarn 16 with which the winding drum is to be untilized, so that the grooves 9, 10 are of sufficient size for easy entry and exit of the yarn 16. While the cross-section of the grooves 9, 10 may be considerably larger than the cross-section of the yarn to achieve this purpose, the yarn may tend to catch or lodge within the grooves if the cross-section of the grooves is the same as or less than the yarn cross-section.

The operation of the present invention may thus be understood. In FIG. 1, the traversing yarn guide 14 is shown in the rightwardmost point of its traversing path adjacent the rightwardmost end 6 of the winding drum 4 whereat the yarn guide 14 has completed its rightward traversing movement and is reversing to traverse leftwardly with respect to the winding drum 4 and the wound bobbin 1. As the yarn 16 exits the guide 14, the yarn 16 is directed between two of the knob-like projections 12 and thereby the winding direction of the yarn 16 changes at the corresponding yarn engagement location 11 between the projections 12 as the guide 14 reverses its traversing direction. The two knob-like projections 12 substantially fix the disposition of the yarn 16 and prevent it from being drawn axially away from the end of the wound bobbin 1 despite the leftward movement of the yarn guide 14 and the angular change in the winding direction of the yarn. As a result, the yarn 16 is deposited by the winding drum 4 onto the wound bobbin 1 in substantially the desired cross-winding pattern, thereby imparting a substantially uniform density to the entire body of yarn wound on the bobbin tube 2, which as aforementioned is particularly advantageous in the formation of dye bobbins.

Figure 2:
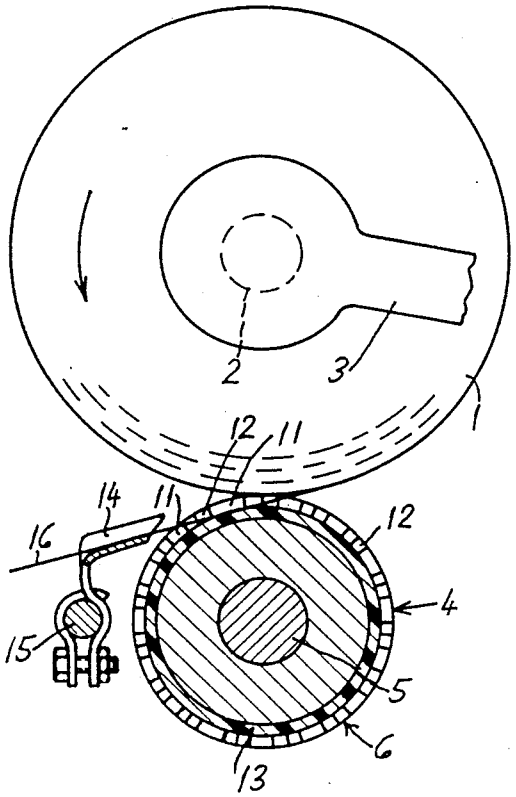
FIG. 2 is a cross-sectional view of the yarn cross-winding apparatus of FIG. 1 taken along line II—II thereof.

With reference now to FIG. 2, the yarn winding apparatus is shown as viewed along line II—II of FIG. 1, with the wound bobbin 1 and its bobbin holder 3 in end elevation and the winding drum 4 in cross-section. As seen, the bobbin holder 3 acts through the bobbin tube 2 to hold the wound bobbin 1 in peripheral surface contact with the winding drum 4. The winding drum 4 along with its drive shaft 5 is shown sectioned in the area of its rightward end 6, whereby the friction coating 13 about the end 6 of the winding drum, the intersections of the grooves 9, 10 in the friction coating 13 forming the yarn engagement locations 11, and the knob-like projections 12 can be seen. As in FIG. 1, the yarn guide 14 is shown at the completion of the rightward stroke of its traverse. The yarn 16 is directed tangentially to the winding drum 4 in contact with the grooved periphery at a yarn engagement location 11 in advance of the passage of the yarn 16 tangentially onto the periphery of the wound bobbin 1. As is apparent, the yarn 16 loops about a knob-like projection 12 and is thereby retained at the yarn engagement location 11 in the desired cross-wound disposition determined by the traversing movement of the yarn guide 14 so as to be deposited on the periphery of the wound bobbin 1 substantially in such disposition. Thus, as aforedescribed, the knob-like projections 12 which define the yarn engaement locations 11 prevent the yarn 16 from undesirably being drawn axially inwardly away from the ends of the wound bobbin 1, which otherwise would occur in the case of a conventional winding drum 4 having an entirely smooth periphery. Of course, within the intermediate region of the traversing movements of the yarn guide 14 in the region of the smooth central area 8 of the winding drum 4, the guiding and application of the yarn 16 onto the wound bobbin 1 is controlled entirely by the yarn guide 14 in a usual manner.

While the yarn winding apparatus of the present invention has herein been described with respect to a preferred embodiment thereof for winding a cylindrical cross-wound bobbin, it will be understood by those persons skilled in the art that a winding drum according to the present invention may also be utilized for winding conical cross-wound bobbins of any conicity. In such embodiments, it is contemplated to be abvantageous, because of the conicity of the bobbin, that the grooved peripheral areas at opposite ends of the winding drum have different arrangements of the yarn engagement locations from one another in order to accommodate the winding geometry of conical cross-wound bobbins. This may be achieved, for example, by differently positioning the parallel rows of grooves relative to the axis of the winding drum at the respective peripheral end areas thereof.

It will therefore by readily understood by those persons skilled in the art that the present invention is susceptible of a broad utility and application. Many embodiments and adaptations of the present invention other than those herein described, as well as many variations, modifications and equivalent arrangements will be apparent from the reasonable suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for cross-winding a traveling yarn on a bobbin comprising a driven winding drum for peripheral contact with said bobbin for driving rotation thereof, and yarn guide means for traversing movement along said bobbin for applying the yarn in a cross-wound fashion to the periphery of said bobbin, said winding drum having two peripheral areas spaced from one another along said winding drum for contact respectively with opposite end areas of said bobbin whereat reversal of the cross-winding of the yarn occurs and a generally smooth peripheral area along said winding drum between said spaced peripheral areas, each said spaced peripheral area defining for any given said bobbin a plurality of discrete yarn engagement members spaced with respect to one another over the circumferential and axial extents of said spaced peripheral area, each said yarn engagement member being adapted for guiding the yarn onto said bobbin at its opposite end areas to resist axially inward deviation of the yarn from its cross-winding angle at the location of yarn cross-winding reversal.

2. Apparatus for cross-winding a traveling yarn according to claim 1 and characterized further in that said spaced peripheral areas of said winding drum comprise respective peripheral grooves oppositely formed obliquely to the axis of said winding drum for intersecting one another, said yarn engagement members being formed at the intersections of said grooves.

3. Apparatus for cross-winding a traveling yarn according to claim 1 and characterized further in that said yarn engagement members are aranged in paralle rows to one another.

4. Apparatus for cross-winding a traveling yarn according to claim 1 and characterized further in that said yarn engagement members are staggered relative to one another.

5. Apparatus for cross-winding a traveling yarn according to claim 1 and characterized further in that each of said spaced peripheral areas of said winding drum comprises a frictional surface.

* * * * *